US010825437B2

(12) United States Patent
Queal

(10) Patent No.: US 10,825,437 B2
(45) Date of Patent: Nov. 3, 2020

(54) STRINGED-INSTRUMENT AMPLIFICATION

(71) Applicant: Peter D. Queal, Greeley, CO (US)

(72) Inventor: Peter D. Queal, Greeley, CO (US)

(73) Assignee: PQ PRODUCTIONS LLC, Greeley, CO (US)

( * ) Notice: Subject to any disclaimer, the term of this patent is extended or adjusted under 35 U.S.C. 154(b) by 0 days.

(21) Appl. No.: 16/446,418

(22) Filed: Jun. 19, 2019

(65) Prior Publication Data

US 2020/0193951 A1 Jun. 18, 2020

Related U.S. Application Data

(60) Provisional application No. 62/778,396, filed on Dec. 12, 2018.

(51) Int. Cl.
*G10H 3/18* (2006.01)
*G10D 3/04* (2020.01)

(52) U.S. Cl.
CPC ..... *G10H 3/18* (2013.01); *G10D 3/04* (2013.01); *G10H 2220/461* (2013.01)

(58) Field of Classification Search
CPC .. A61M 2205/3375; A61M 2021/0022; A61M 2205/3331; A61M 2205/332; A61M 2205/3334; A61M 2205/3327; A61M 5/16886; A61M 1/127; G10H 1/00; G10H 1/0058; G10H 2220/525; G10H 1/0091; G10H 2220/535; G10H 2220/561; G10H 2220/461; G10H 3/181; G10H 3/186; H01M 10/425; H01M 10/46; H01M 10/48; H01M 2220/30; H01M 2/1022; H01M 6/02; H01M 6/5044; H01M 2010/4278; H01M 10/39; H01M 10/4257; H01M 10/44; H01M 16/00; H01M 2010/4271; H01M 2220/10; H01M 2/0237; H01M 8/00; H01M 4/90; H01M 8/0606; H01M 8/16; H01M 2/10; H01M 2/1077; H01M 10/441; H01M 2220/20; H01M 2/1016; H01M 2/1083; H01M 2/206; H01M 2/26; H01M 10/052; H01M 10/0568; H01M 10/54; H01M 10/613; H01M 10/643; H01M 10/6557; H01M 10/6562; H01M 10/6563;
(Continued)

(56) References Cited

U.S. PATENT DOCUMENTS 4,232,582 A * 11/1980 Diamond ..... G10D 1/08 181/131
4,944,016 A 7/1990 Christian
5,078,041 A 1/1992 Schmued
(Continued)

*Primary Examiner* — Marlon T Fletcher
(74) *Attorney, Agent, or Firm* — MP Patents, LLC

(57) ABSTRACT

The disclosure seeks to describe a system and method for transmitting acoustic energy to a listener. The system includes a flexible pick-up, at least one acoustic energy transmisson member and at least one audio output. The flexible pick-up has an interior, at least one opening, and is configured for compression against strings of a stringed instrument for direct energizing by the strings. The at least one acoustic energy transmission member has a first end coupled to the interior of the pick-up through the opening. The at least one audio output is mounted on a second end of the energy transmission member and is configured to transmit acoustic energy therefrom to a listener.

18 Claims, 8 Drawing Sheets

(58) Field of Classification Search
CPC .... H01M 2/105; H01M 2/1055; H01M 2/202; H01M 6/36; G10K 11/004
See application file for complete search history.

(56) References Cited

U.S. PATENT DOCUMENTS

| | | | | |
|---|---|---|---|---|
| 5,410,101 | A | 4/1995 | Sakurai | |
| 5,817,966 | A | 10/1998 | Fishman | |
| 8,263,851 | B2 | 9/2012 | Barbera | |
| 9,833,373 | B2 | 12/2017 | Brouillette et al. | |
| 2002/0157523 | A1 | 10/2002 | Takabayashi | |
| 2004/0105560 | A1 | 6/2004 | Naniki | |
| 2009/0038461 | A1 | 2/2009 | Dunwoodie | |
| 2015/0371623 | A1* | 12/2015 | Gillette ..... | G10H 3/181 84/726 |

* cited by examiner

STRINGED-INSTRUMENT AMPLIFICATION

CROSS-REFERENCE TO RELATED APPLICATIONS

This application claims priority to and incorporates by reference in its entirety U.S. Provisional Application No. 62/778,396 filed Dec. 12, 2018 and entitled 'STRINGED-INSTRUMENT AMPLIFICATION'.

TECHNICAL FIELD

The present disclosure relates to amplification of instruments including stringed instruments.

SUMMARY

The disclosure describes a system for transmitting acoustic energy to a listener. The system includes a flexible pick-up, at least one acoustic energy transmission member and at least one audio output. The flexible pick-up has an interior, at least one opening, and is configured for compression against strings of a stringed instrument for direct energizing by the strings. The at least one acoustic energy transmission member has a length and a first end coupled to the interior of the pick-up through the opening and configured to transmit acoustic energy along the length. The at least one audio output is mounted on a second end of the acoustic energy transmission member and is configured to transmit acoustic energy from the acoustic energy transmission member to a listener.

Further, the disclosure describes an amplified, stringed instrument. The instrument includes an instrument body having an upper surface, strings coupled to the body and supported above the upper surface with a bridge, a pick-up compressed against the strings for direct energizing thereby, at least one acoustic energy transmission member and at least on audio output mounted on a second end of the energy transmission member. The pick-up has an interior and at least one opening. The at least one acoustic energy transmission member as a length and a first end coupled to the interior of the pick-up through the at least one opening and is configured to transmit acoustic energy along the length. The at least one audio output is configured to transmit acoustic energy from the acoustic energy transmission member to a listener.

BRIEF DESCRIPTION OF THE FIGURES

The summary above, as well as the following detailed description of illustrative embodiments, is better understood when read in conjunction with the appended figures. For the purpose of illustrating the disclosure, example constructions are shown in the figures. However, the disclosure is not limited to specific methods and instrumentalities disclosed herein. Moreover, those having ordinary skill in the art will understand that the figures are not to scale. Wherever possible, like elements have been indicated by identical numbers.

Embodiments of the disclosure will now be described, by way of example only, with reference to the following diagrams wherein.

DETAILED DESCRIPTION

The following detailed description illustrates embodiments of the disclosure and manners by which they can be implemented. Although the best mode of carrying out disclosed systems, apparatuses and methods has been described, those of ordinary skill in the art would recognize that other embodiments for carrying out or practicing disclosed systems, apparatuses and methods are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Systems and methods of the disclosure substantially eliminate, or at least partially address, problems in the prior art enabling selective isolation of musicians from inadvertent listeners or loud environments during practice or performance. The sound of any stringed instrument may be amplified without electrical power facilitating collaboration between instrumentalists. The full energy of vibrating strings is captured through direct contact with each string and resonance in a closed system. Contact of the exterior wall of the pick-up with the strings provides highly defined and discreet pick up of the vibration from each string. Disclosed systems and methods capture acoustic string energy from solid- or hollow-bodied, stringed, musical instruments and transfer the energy to a listener through hollow tubing to one or more outputs such as headphones.

Additional aspects, advantages, features and objects of the disclosure will be made apparent from the figures and the detailed description of the illustrative embodiments construed in conjunction with the appended claims that follow.

It will be appreciated that described features are susceptible to being combined in various combinations without departing from the scope of the disclosure as defined by the appended claims.

Figure 1:
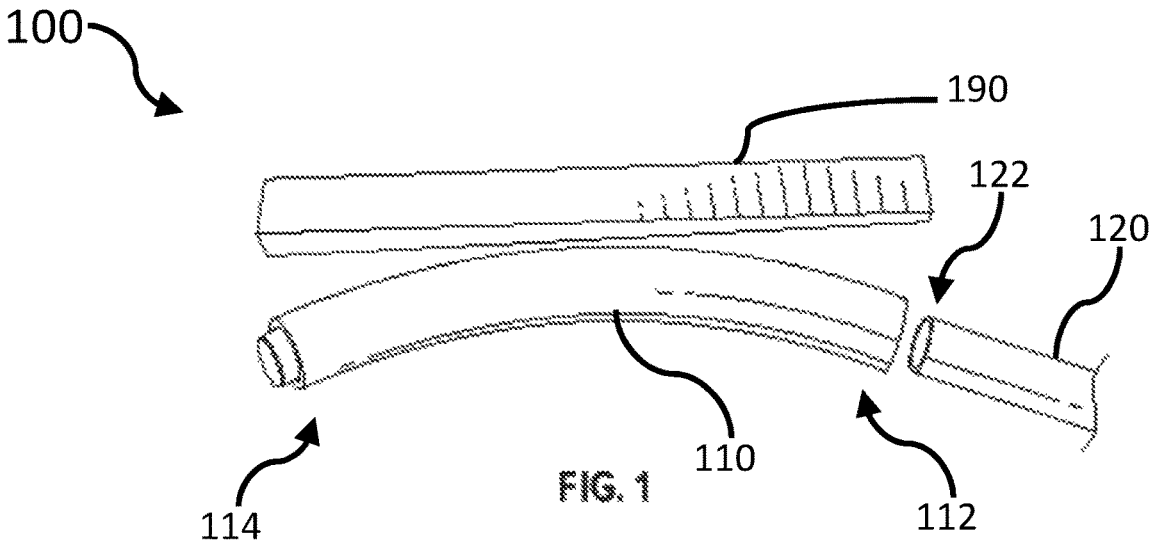
FIG. 1 illustrates an example system for amplifying stringed instruments, transmitting mechanical energy to a user and/or transmitting acoustic energy to a listener.
Figure 2:
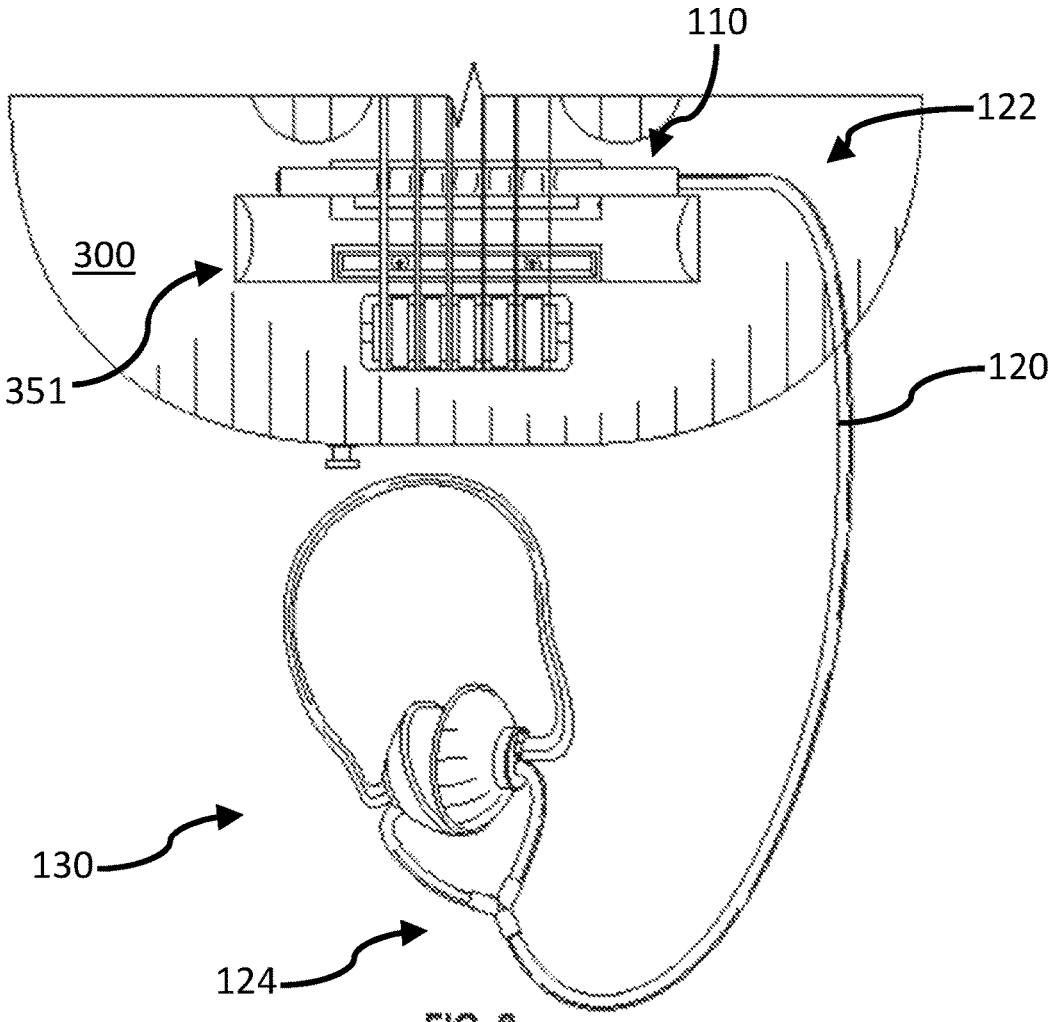
FIG. 2 illustrates a top view of an example stringed instrument amplified in accordance with disclosed systems and methods.
Figure 3:
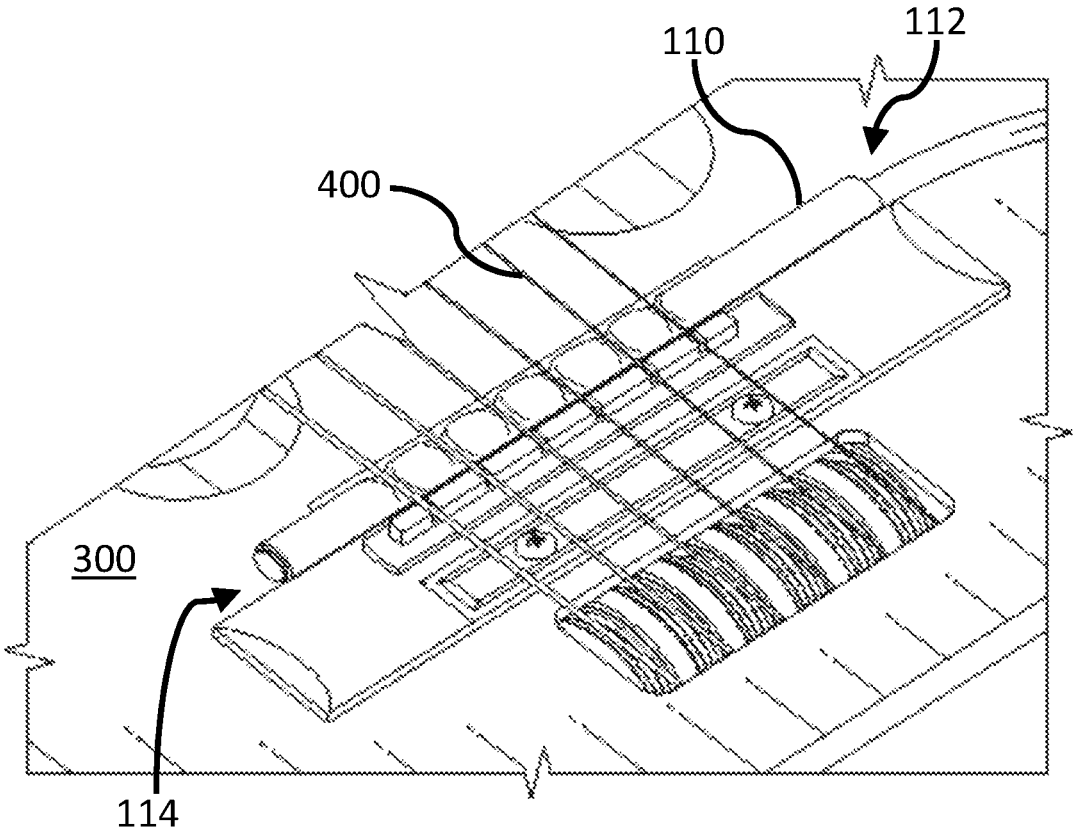
FIG. 3 illustrates a top, perspective view of an example stringed instrument amplified in accordance with disclosed systems and methods.
Figure 4:
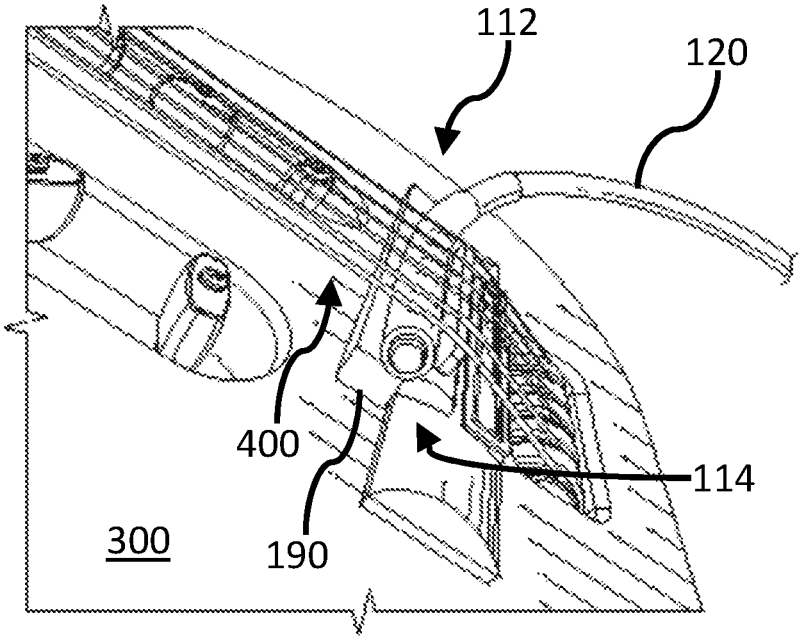
FIG. 4 illustrates a side, perspective view of an example stringed instrument amplified in accordance with disclosed systems and methods.

FIGS. 1 & 2 illustrate an example system 100 for amplifying stringed instruments, transmitting mechanical energy to a user and/or transmitting acoustic energy to a listener.

System 100 includes a pick-up 110 in the form of an energy pick-up chamber, at least one acoustic energy transmisson member 120 and at least one output 130. Acoustic energy transmission member 120 may transmit mechanical energy in the form of acoustic energy and the at least one output 130 may output audio.

Pick-up 110 has an interior, at least one opening and is configured for compression against strings of a stringed instrument for direct energizing by the strings. For example, pick-up 110 may be configured for orientation transverse to the strings and to mate with the strings to transmit energy therefrom while minimally limiting or impeding natural vibration of the strings. The at least one opening of pick-up 110 may be positioned at a first end 112 thereof opposite a second end 114 which is closed.

Pick-up 110 is configured to operate pneumatically and without electricity. Energy is transmitted from instrument strings to a fluid in pick-up 110. Any of a variety of fluids suitable for transmitting mechanical and/or acoustic energy may be surrounded by pick-up 110 including but not limited to various gasses. Any of a variety of gasses may be suitable including but not limited to air.

Pick-up 110 may be formed from any of a variety of substantially fluid-tight, elastomeric materials suitable for transmitting mechanical and/or acoustic energy in the form of sound waves. Suitable materials include but are not limited to rubber, latex and silicone.

Pick-up 110 may have a length that is large relative to its width, may have a density that increases along the length and/or may taper along the length such that the sustain of each string is substantially well-preserved. Pick-up 110 may be tubular and include curved interior surfaces and curved exterior surfaces and a cross-section resembling a torus of revolution.

Figure 11:
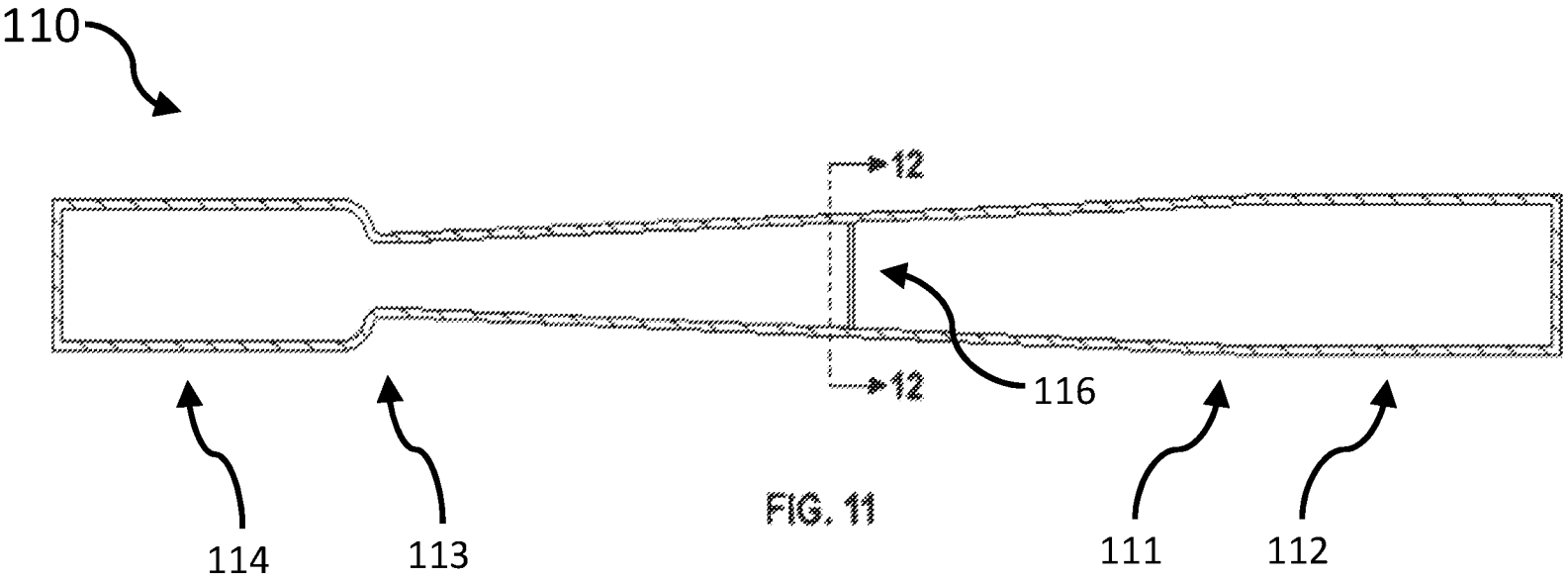
FIG. 11 illustrates a longitudinal, cross-sectional view of an example pick-up in accordance with disclosed systems and methods.

FIG. 11 illustrates a cross-sectional view of an example pick-up 110 in accordance with disclosed systems and methods. Pick-up 110 includes a taper between first end 112 and second end 114 which begins at transition region 111 and concludes at transition region 113. While pick-up 110 may be constructed to any of a variety of dimensions depending on the instrument being amplified and the preferences of the end user, in an example, the length is 4¾", the diameter at first end 112 is ⅜" and at length equal to 1⅛" begins to taper down ultimately reaching a diameter of ¼" at length equal to 3½". After, achieving the ¼" diameter, the diameter transitions back to ⅜" over ⅛" of additional length and continues at this diameter until reaching the second end 114. In an example, the thickness of the walls of pick-up 110 is about 1/16"

In an example, pick-up 110 is configured for compression between a body surface 300 of a stringed instrument and strings 400 thereof for direct energizing by strings 400 (FIGS. 1-4, 6). A pick-up support 190 may be provided to support pick-up 110 above the body surface and in close, pressurized contact with strings 400 (FIGS. 2-4, 6). Pick-up support 190 may take any of a variety of shapes suitable for supporting pick-up 110 in a position above the body surface so as to be directly energized by instrument strings 400. Shapes include but are not limited to a wedge shape. Such a wedge shape may contribute to a taper effect of pick-up 110 in its compression against strings 400 such that the sustain of the instrument is substantially consistent across all the strings. Pick-up support 190 may be formed from any of a variety of substantially rigid, durable materials including but not limited to wood and hard plastic.

In a monophonic configuration (FIGS. 1-4), the at least one opening of the flexible pick-up is positioned at first end of 112 of flexible pick-up 110 which is closed at a second end 114. Second end 114 may be closed by a closure formed integral with pick-up 110 at the time of manufacture or may be closed by a closure such as a plug provided as a separate component selectively receivable within pick-up 110.

Figure 5:
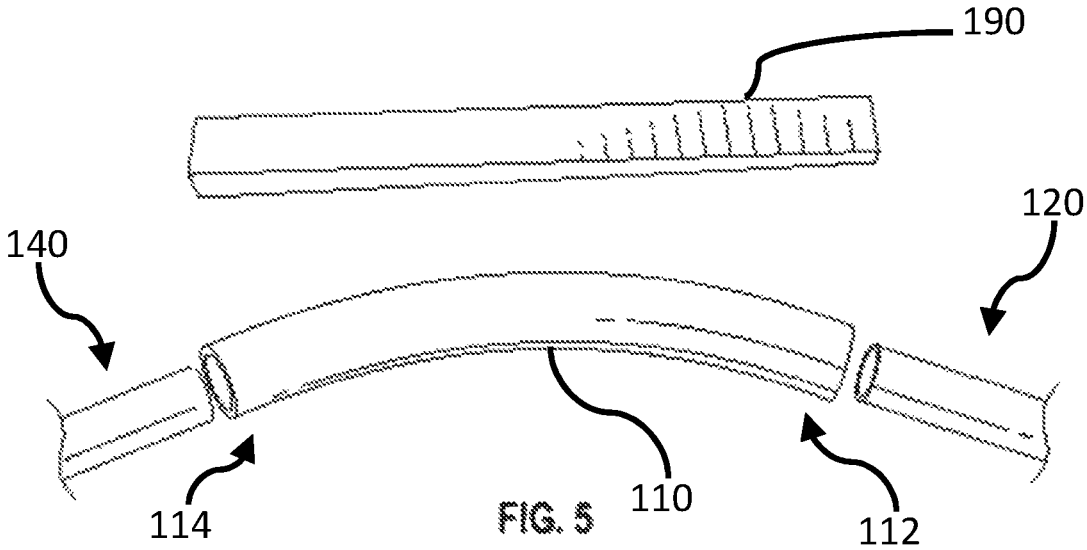
FIG. 5 illustrates another example system for amplifying stringed instruments, transmitting mechanical energy to a user and/or transmitting acoustic energy to a listener.

In a stereophonic configuration (FIGS. 5 & 6), the at least one opening includes a first opening at first end 112 of pick-up 110 and a second opening at second end 114 opposite first end 112. With a divider 116 (FIGS. 11 & 12) between first and second ends 112 and 114 and, for example, substantially mid-way between the ends, the first and second openings cooperate to produce stereo sound. Separation between first and second ends 112 and 114 may be accomplished either with an internal wall such as divider 116 or by a ligation constricting pick-up 110 between the ends 112 and 114. On a normal stringed-instrument having a set of strings progressing in pitch, a left channel may transmit higher pitched tones while the right channel may transmit lower pitched tones.

Figure 12:
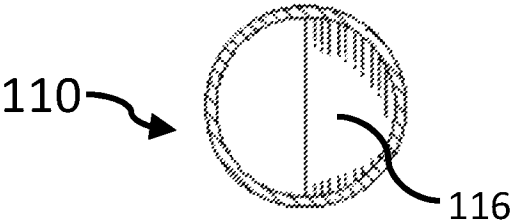
FIG. 12 illustrates a transverse, cross-sectional view of an example pick-up in accordance with disclosed systems and methods.

Divider 116 may be positioned approximately halfway along the length of pick-up 110 or about 1 3/16" away from each of transition regions 111 and 113. Divider 116 may be provided integral with pick-up 110 or may be a separate component selectively installed within pick-up 110 and is configured to increase separation between ends 112 and 114 to enhance stereo effect. Divider 116 may be formed so as to separate to any of a variety of degrees between zero with no separation, to 180 degrees as seen in FIG. 12, to 360 degrees with complete separation. When divider 116 sweeps through less than 360 degrees of the transverse cross-section of pick-up 110, for example, 180 degrees as viewed in FIG. 12, rotating pick-up 110 about its longitudinal axis will vary the opening size through divider 116 given that pick-up 110 is flexible and will be partially compressed by engagement with the instrument strings.

Referring to FIGS. 7-10, in another example, pick-up 110 may be woven between strings 400 such that a pick-up support like 190 is unnecessary for compressing pick-up 110 against strings 400. Flexible pick-up 110 may be configured for passing over a first string and under a second string adjacent to the first string. The weave pattern of pick-up 110 may be adjusted depending on the number of strings of the instrument such that it is directed substantially towards instrument body 300 at ends 112 and 114 and will not interfere with a user's plucking, strumming or stroking of strings 400.

As discussed above with respect to the wedged arrangement of pick-up 110, in a monophonic configuration of the woven arrangement (FIGS. 7-9), the at least one opening of the flexible pick-up is positioned at first end of 112 of flexible pick-up 110 which is closed at a second end 114. Second end 114 may be closed by a closure formed integral with pick-up 110 at the time of manufacture or may be closed by a closure such as a plug provided as a separate component selectively receivable within pick-up 110.

In a stereophonic configuration of the woven arrangement (FIG. 10), the at least one opening includes a first opening at first end 112 of pick-up 110 and a second opening at second end 114 opposite first end 112. A divider 116 or ligature may be applied to or otherwise provided to pick-up 110 to enhance separation between left and right channels of the stereophonic configuration.

Figure 6:
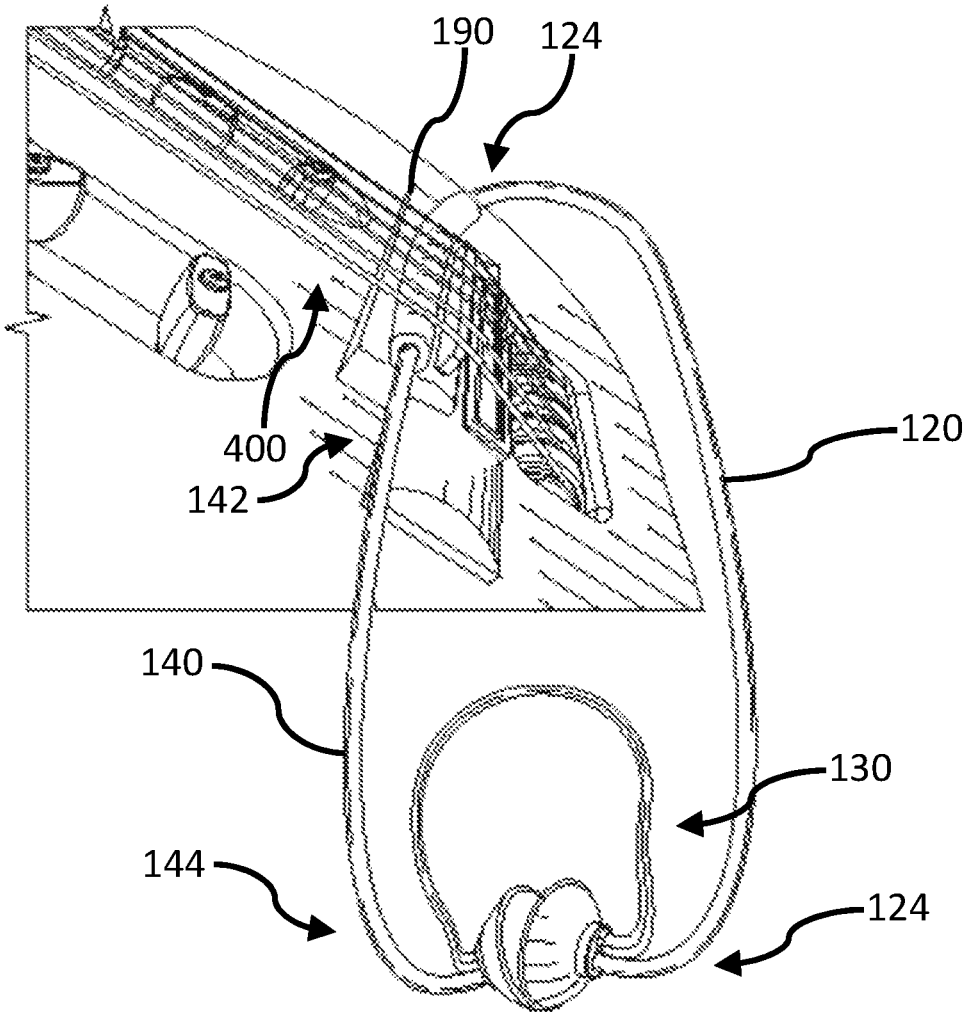
FIG. 6 illustrates a side, perspective view of an example stringed instrument stereophonically amplified in accordance with disclosed systems and methods.
Figure 7:
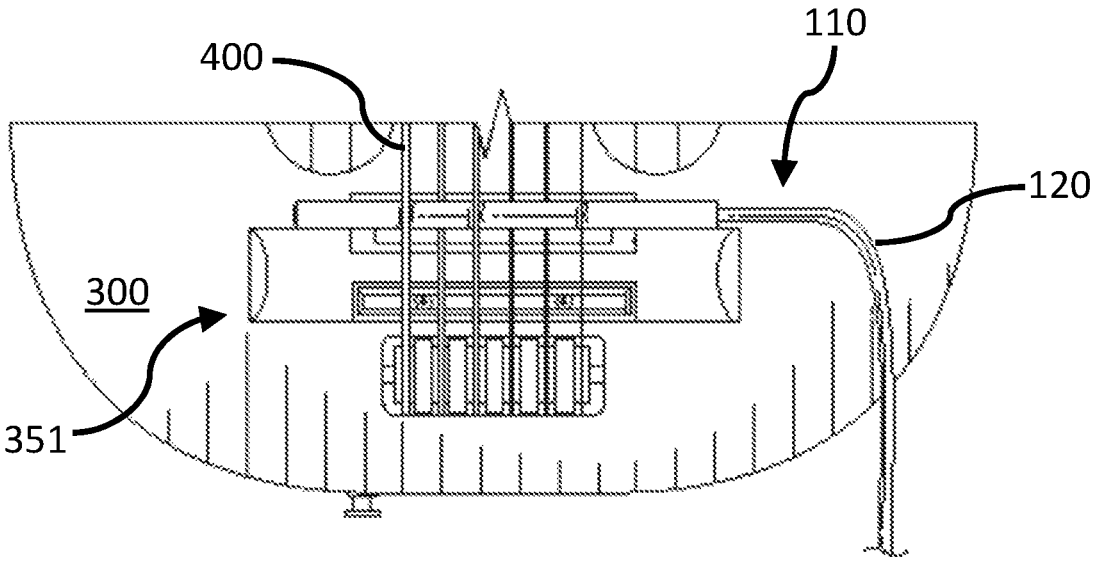
FIG. 7 illustrates a top view of an example stringed instrument amplified in accordance with disclosed systems and methods.
Figure 8:
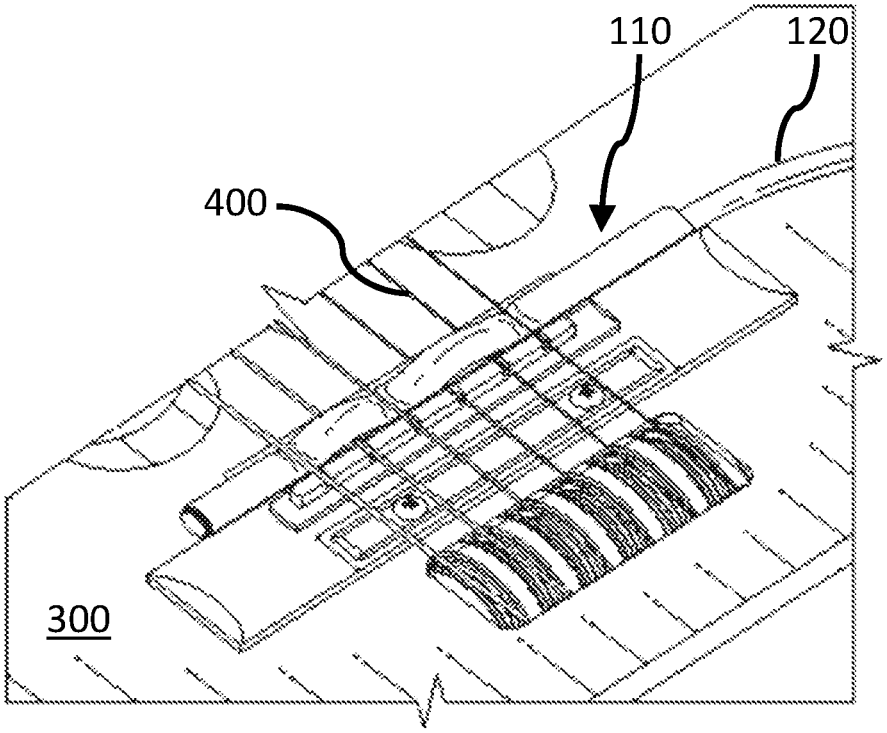
FIG. 8 illustrates a top, perspective view of an example stringed instrument amplified in accordance with disclosed systems and methods
Figure 9:
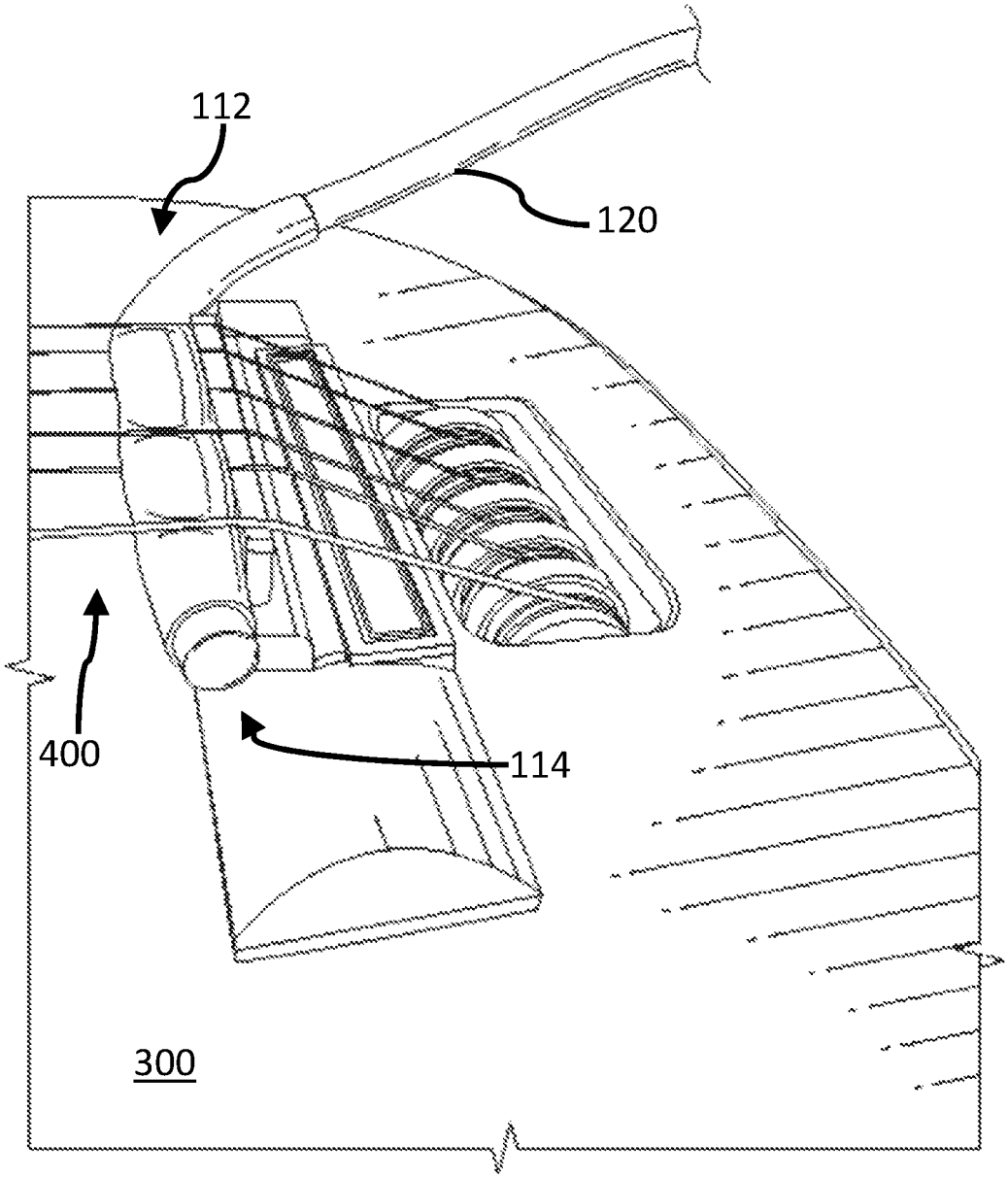
FIG. 9 illustrates a side, perspective view of an example stringed instrument amplified in accordance with disclosed systems and methods.
Figure 10:
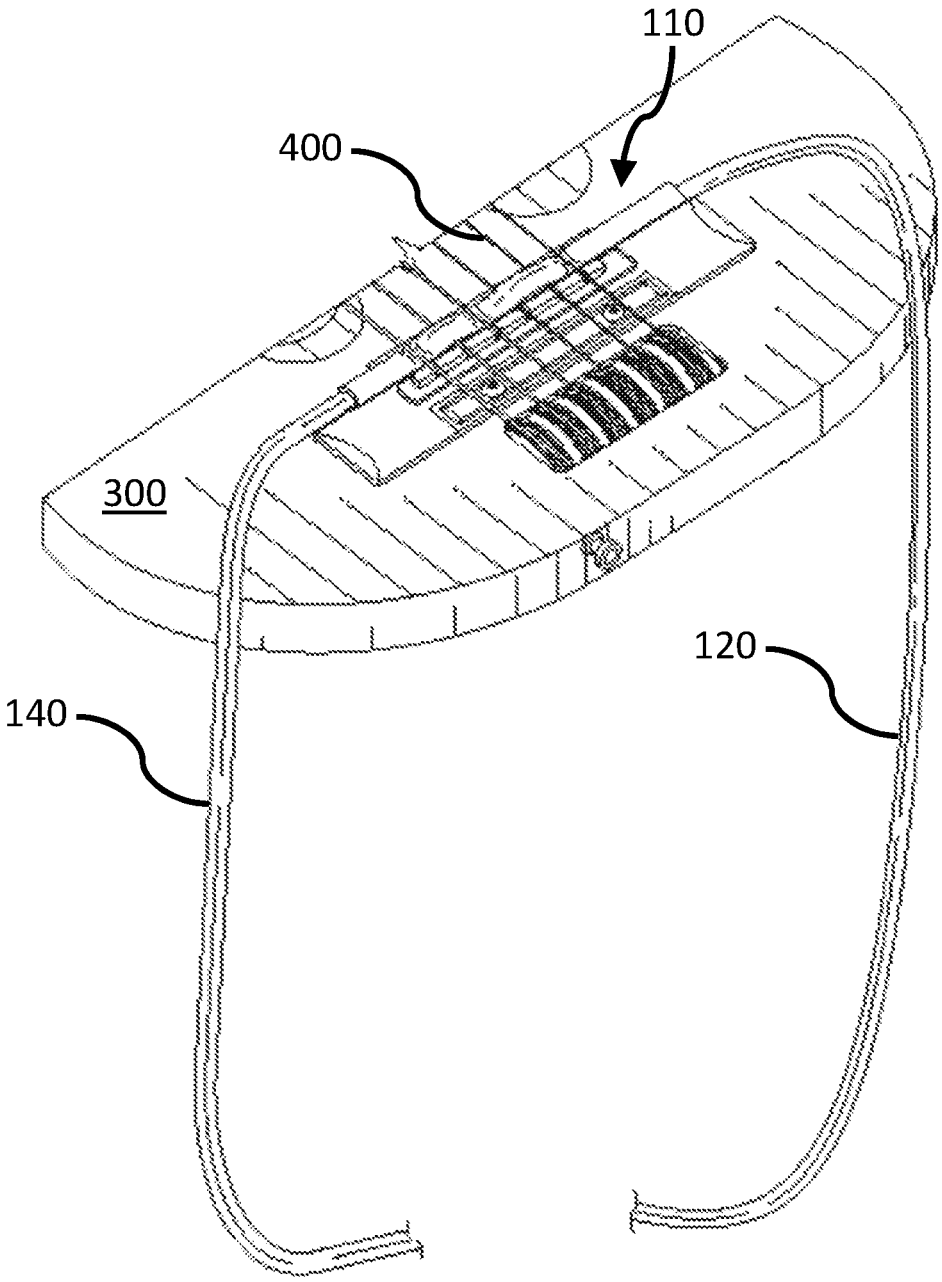
FIG. 10 illustrates a top, perspective view of an example stringed instrument stereophonically amplified in accordance with disclosed systems and methods.

Acoustic energy transmission 120 member may be configured to operate pneumatically and without electricity. The at least one acoustic energy transmission member 120 has a first end 122 coupled to the interior of pick-up 110 through the first opening and is configured to transmit mechanical and/or acoustic energy along its length through a fluid therein to a second end 124 (FIGS. 2 & 6). Similar to pick-up 110, the fluid within acoustic energy transmission member 120 may include but is not limited to any of a variety of gasses. Gas within acoustic energy transmission member 120 may include but is not limited to air.

In the stereophonic configuration, the at least one acoustic energy transmission member 120 further includes an additional acoustic energy transmission member 140 having first end 142 coupled with the interior of pick-up 110 through the second opening and configured to transmit acoustic energy along its length through a fluid therein to a second end 144 (FIG. 6).

Output 130 may also be configured to operate pneumatically and without electricity. The at least one output 130 is mounted on a second end 124 of energy transmission member 120 and is configured to transmit acoustic energy to a listener. In a stereophonic configuration (FIG. 6), the at least one output is coupled with both second end 124 of acoustic energy transmission member 120 and second end 144 of additional acoustic energy transmission member 140.

In systems wherein the at least one output 130 is an audio output and is configured to transmit acoustic energy to a listener, it may include an earpiece. The earpiece may be an earphone designed to fit over and substantially surround the user's ear (FIGS. 2 & 6) or may be an earbud designed to fit within a user's ear.

Figure 13:
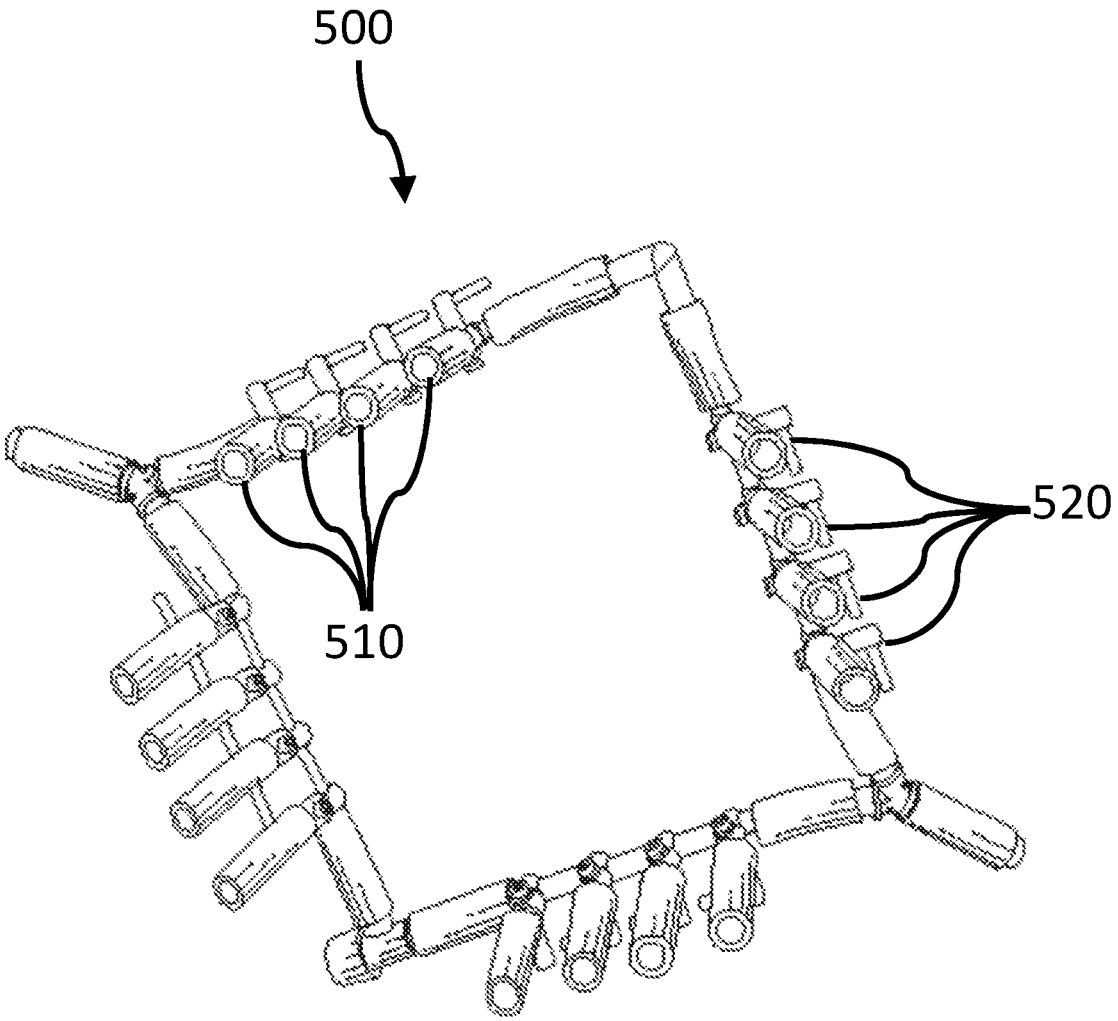
FIG. 13 illustrates a top view of an example valve assembly suitable for use with disclosed systems and methods.

Multiple stringed instruments may be amplified at one time using disclosed techniques and multiple listeners may receive acoustic energy from one or more instruments through multiple outputs. FIG. 13 illustrates a valve assembly 500 suitable for use with disclosed amplification systems. Valve assembly 500 includes a number of ports 510 along each of the four sides shown. Any of ports 510 may be used as an input or as an output depending on user preference. For example, a user may couple one or more acoustic energy transmission members from a first instrument to one or more of ports 510, couple one or more acoustic energy transmission members from a second instrument to one or more of ports 510 and, to one or more of the ports 510, couple several acoustic energy transmission members leading to a number of audio outputs such that two or more listeners can enjoy the acoustics of both of the first and second instruments through the audio outputs.

There is no theoretical limit to the number of ports which may be provided and, as such, there is no limit to the number of instruments that can provide input to valve assembly 500 and no limit to the number of listeners who can enjoy the acoustics of any instruments plugged into valve assembly 500. Ports 510 may be selectively turned off through rotation of levers 520 to seal ports 510. Valve assembly 500 may take any of a variety of shapes or configurations suitable for acoustically coupling one or more pneumatically amplified instruments and/or one or more acoustic/audio outputs.

A method for providing an amplified stringed instrument will now be described. The method includes providing an instrument body 300 having an upper surface and coupling strings 400 to body 300 proximal to the upper surface, for example, through a saddle and/or a bridge 351 and/or bridge pins and/or a tailpiece and/or a headstock and/or tuning machines. With the stringed instrument provided, a user may amplify the same with one of the above-described systems.

In a first example arrangement (FIGS. 2-4 & 6), a pick-up 110 in the form of an energy pick-up chamber having an interior and at least one opening is placed between the upper surface of body 300 of the instrument and strings 400. A pick-up support 190 in the form of a wedge may be provided to the body surface to support pick-up 110 above the body surface and in contact with the instrument strings 400. In an example, pick-up 110, which may be provided into contact with strings 400 at any of a variety of angles relative thereto, is provided substantially transverse to instrument strings 400. In the transverse orientation, a given end of pick-up 110 may be provided under the string of highest pitch while the other end of pick-up 110 is provided under the string of the lowest pitch, in accordance with the user's preference. For example, the smallest diameter region of pick-up 110 may be placed under the highest pitch string while the largest diameter region of pick-up 110 is placed under the lowest pitch string or vice versa.

In a second example arrangement (FIGS. 7-10), a pick-up 110 in the form of an energy pick-up chamber having an interior and at least one opening is woven through strings 400 of the instrument eliminating the need for a pick-up support. Any of a variety of weave patterns may be used provided pick-up 110 is sufficiently compressed against strings 400 so that acoustic energy from the vibrating strings is effectively transmitted through the body of pick-up 110 into its interior.

The weave pattern of pick-up 110 may be adjusted depending on the number of strings such that it is directed substantially towards the instrument body at the ends and will not interfere with a user's plucking, strumming or stroking of the strings. On an odd-stringed instrument, pick-up 110 will alternate under a first string and then over the next string. However, on an even-stringed instrument, it will be necessary for pick-up 110 to pass either under or over both of two consecutive strings 400 in order for it to pass under the outermost strings and be directed towards instrument body 300.

In an example weave into a five-string instrument, pick-up 110 is woven so as to pass under the first string, over the second string adjacent to the first string, under the third string adjacent to the second string, over the fourth string adjacent to the third string and under the fifth string adjacent to the fourth string.

In an example weave into a six-string instrument, pick-up 110 is woven so as to pass under the first string, over the second string adjacent to the first string, over the third string adjacent to the second string, under the fourth string adjacent to the third string, over the fifth string adjacent to the fourth string and under the sixth string adjacent to the fifth string.

Regardless of whether pick-up 110 is compressed between instrument body 300 and strings 400 or woven through strings 400, a first end 122 of a acoustic energy transmission member 120 is coupled to the interior of the placed pick-up 110 through the at least one opening and at least one audio output 130 is mounted on a second end 124 of energy transmission member 120. Acoustic energy is transmitted from the vibrating strings to pick-up 110, through pick-up 110, through energy transmission member 120, through audio output 130 and on to a listener.

To provide a user with a stereophonically amplified stringed instrument, after pick-up 110 has been installed against instrument strings 400 and first acoustic energy transmission member 120 has been coupled, a first end 142 of a second acoustic energy transmission member 140 is coupled to the interior of pick-up 110 through a second opening opposite the first opening and audio output 130 is further mounted on a second end 144 of second acoustic energy transmission member 140. Acoustic energy is transmitted from the vibrating strings to pick-up 110, through pick-up 110, through both of the energy transmission members 120 and 140, through audio output 130 and on to the listener.

Depending on particular mounting choice of pick-up 110 to strings 400 in the stereophonic arrangement, a first acoustic energy transmission member 120 may transmit acoustic energy from a first range of pitches while a second acoustic energy transmission 140 member transmits acoustic energy from a second range of pitches such that the user hears the first range of pitches in a first ear and the second range of pitches in a second ear.

The actions described with respect to disclosed methods are only illustrative and other alternatives can also be provided where one or more actions are added, one or more actions are removed, or one or more actions are provided in a different sequence without departing from the scope of the claims herein.

Embodiments of the disclosure are susceptible to being used for various purposes, including, though not limited to, enabling users to amplify instruments and transmit or otherwise deliver acoustic energy in the form of acoustic energy to one or more listeners.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. A system for transmitting acoustic energy to a listener, comprising:

a flexible pick-up having an interior and at least one opening, the flexible pick-up being configured for compression against strings of a stringed instrument such that the flexible pick-up is directly energized by the strings and configured to transmit energy from the strings to a fluid therewithin;

at least one acoustic energy transmission member having a length and a first end coupled to the interior of the pick-up through the at least one opening and configured to transmit acoustic energy along the length; and mounted on a second end of the acoustic energy transmission member, at least one audio output configured to transmit acoustic energy from the acoustic energy transmission member to a listener.

2. The system as set forth in claim 1, wherein the at least one audio output includes an earpiece configured to transmit acoustic energy to an ear of the listener.

3. The system as set forth in claim 1, wherein the flexible pick-up tapers along its length.

4. The system as set forth in claim 1, wherein the flexible pick-up is configured for orientation transverse to the strings.

5. The system as set forth in claim 1, wherein the flexible pick-up and the at least one acoustic energy transmission member are configured to operate without electricity.

6. The system as set forth in claim 1, wherein the flexible pick-up is configured for compression between a body surface of a stringed instrument and strings thereof for direct energizing by the strings.

7. The system as set forth in claim 1, wherein the flexible pick-up is configured for weaving between the strings.

8. The system as set forth in claim 1, wherein the at least one opening of the flexible pick-up is positioned at a first end of the flexible pick-up which is closed at a second end.

9. The system as set forth in claim 1, further comprising a second opening opposite the at least one opening.

10. The system as set forth in claim 9, wherein, combined, the at least one opening and the second opening yield stereo sound.

11. The system as set forth in claim 9, wherein the at least one acoustic energy transmission member further comprises an additional acoustic energy transmission member having another length and another first end coupled with the interior of the pick-up through the second opening and configured to transmit acoustic energy along the other length.

12. The system as set forth in claim 11, wherein the at least one audio output is further mounted on a second end of the additional acoustic energy transmission member.

13. An amplified, stringed instrument, comprising:

an instrument body having an upper surface;

strings coupled to the instrument body and supported above the upper surface with a bridge;

compressed against the strings for direct energizing thereby, a pick-up having an interior and at least one opening and being configured to transmit energy from the strings to a fluid therewithin;

at least one acoustic energy transmission member having a length and a first end coupled to the interior of the pick-up through the at least one opening and configured to transmit acoustic energy along the length; and mounted on a second end of the acoustic energy transmission member, at least one audio output configured to transmit acoustic energy from the acoustic energy transmission member to a listener.

14. The stringed instrument as set forth in claim 13, wherein the at least one acoustic energy transmission member is further configured to transmit acoustic energy by a fluid held therewithin.

15. The stringed instrument as set forth in claim 13, wherein the pick-up and the at least one acoustic energy transmission member are configured to operate without electricity.

16. The stringed instrument as set forth in claim 13, wherein the pick-up is compressed between the upper surface and the strings.

17. The stringed instrument as set forth in claim 13, wherein the pick-up is woven between the strings.

18. The stringed instrument as set forth in claim 13, wherein the at least one opening comprises a first opening at a first end of the pick-up and a second opening at a second end of the pick-up opposite the first end.

* * * * *